United States Patent [19]

Walsh

[11] 4,065,100

[45] Dec. 27, 1977

[54] HOIST LOAD BRAKE

[75] Inventor: Michael M. Walsh, Northville, Mich.

[73] Assignee: Eaton Corporation, Cleveland, Ohio

[21] Appl. No.: 655,334

[22] Filed: Feb. 5, 1976

[51] Int. Cl.[2] ..... B66D 1/00

[52] U.S. Cl. ..... 254/167; 188/166; 188/187

[58] Field of Search ..... 254/169, 167, 164, 157, 254/159; 188/135, 166, 187, 72.8, 180; 187/89, 90

[56] References Cited

U.S. PATENT DOCUMENTS

| | | | |
|---|---|---|---|
| 990,029 | 4/1911 | Borden | 254/159 |
| 2,219,551 | 10/1940 | Osgood | 254/187 |
| 2,990,131 | 6/1961 | Carlsson | 254/157 X |
| 3,934,682 | 1/1976 | Hedstrom | 187/89 |

FOREIGN PATENT DOCUMENTS

| | | | |
|---|---|---|---|
| 660,069 | 3/1963 | Canada | 254/166 |

*Primary Examiner*—Robert J. Spar
*Assistant Examiner*—Donald W. Underwood
*Attorney, Agent, or Firm*—Teagno & Toddy

[57] ABSTRACT

An improved load brake mechanism for hoists allows free movement of load supporting means connected with the hoist. The mechanism will stop the supporting means whenever the means achieves a predetermined velocity or acceleration. The braking mechanism allows the convenience of a free chain mode without the risk of an uncontrolled load on the hoist.

7 Claims, 4 Drawing Figures

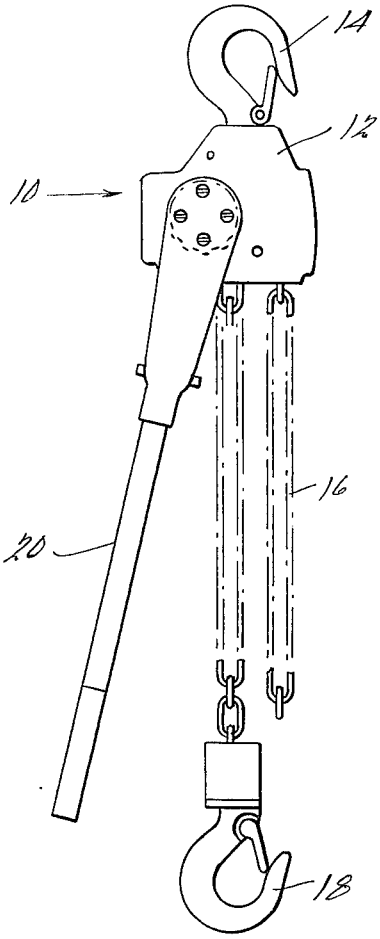
Fig. 1.
Fig. 2.
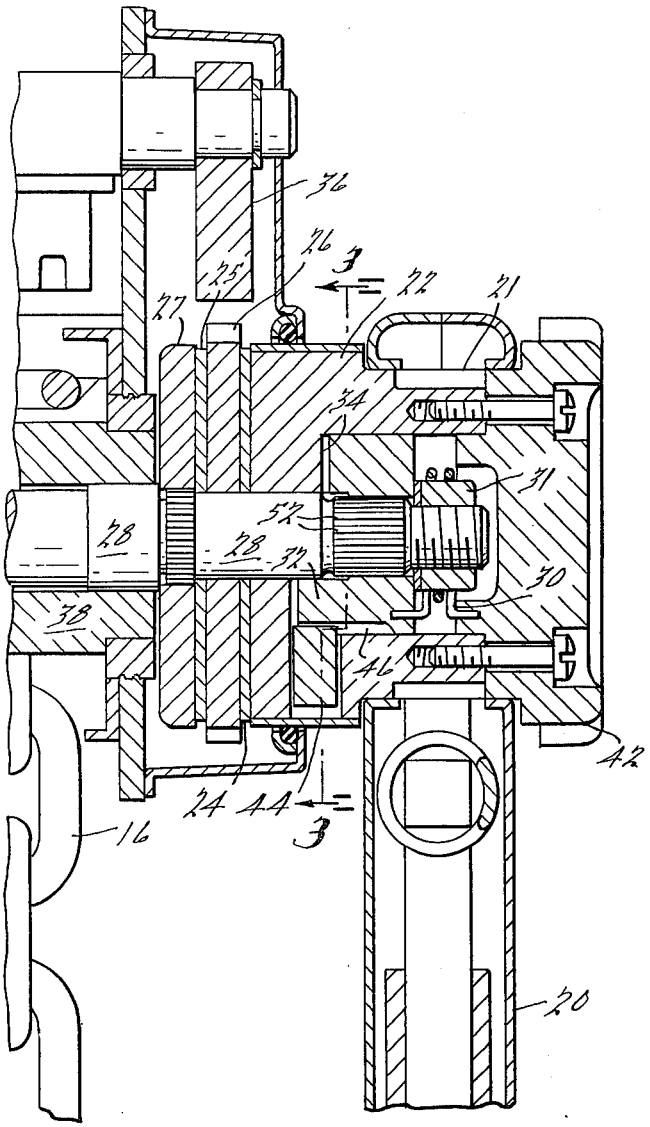
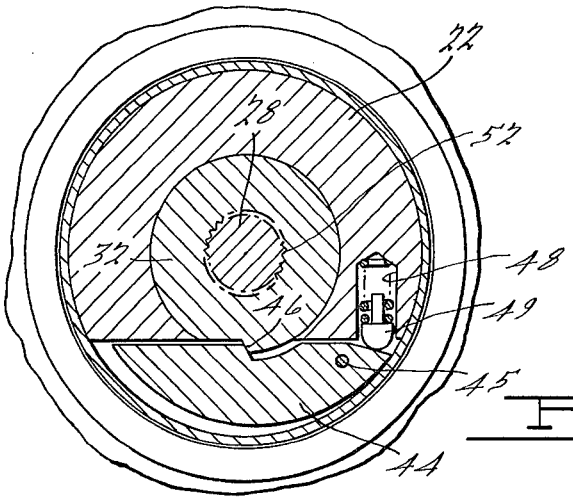
Fig. 3.

HOIST LOAD BRAKE

BACKGROUND OF THE INVENTION

1. Field of the Invention

In one respect this invention relates to braking mechanisms. In a further aspect, this invention relates to chain hoists, especially lever driven hoists.

2. Prior Art

In its most general form the brake of this invention can be used as a safety brake on various lifts and hoists. Many countries and their subdivisions require cranes and lifts to have some safety means for preventing a load from dropping in an uncontrolled manner. Prior art brakes are usually responsive to the acceleration of a dropping load. Such brakes can allow the load to attain a substantial speed where the acceleration is low creating a dangerous uncontrolled load.

One example of hoists is the lever driven chain hoists known in the art. One example is shown in U.S. Pat. No. 3,047,114. In general the prior art lever driven hoists devices have a housing which contains drive means. Power is furnished to the drive means by a lever. The drive means can be set so as to draw or release a load attached to a chain passing through the hoist. Generally the hoist is used to raise and lower loads vertically. When it is desired to move the chain without using the lever the hoist can be set in a free chaining mode which allows the chain to be pulled rapidly through the hoist.

Free chaining allows a rapid movement of the chain but has consequent dangers. If a load is inadvertantly applied or the operator is careless, the chain can move rapidly through the hoist allowing the load to fall in an uncontrolled manner. To solve this problem some prior art hoists are equipped with a brake which is sensitive to acceleration. If the load on one of the prior art hoists suddenly accelerates a braking mechanism is applied and stops the load. However, if the load accelerates slowly it can achieve a substantial velocity without activating the brake. Therefore, even though the risk of injury is lessened, a substantial risk of injury still exists.

SUMMARY OF THE INVENTION

It is an object of this invention to provide a braking system for hoists which responds to velocity as well as acceleration.

It is a further object of this invention to provide a lever operated hoist which will allow free movement of the chain only at low to moderate velocities.

It is yet a further object of this invention to provide a braking system for lever driven hoists which responds to velocity and acceleration.

In general, a hoist includes an input drive means responsive to an input force and an output drive means which engages a holding means suitable for attachment to a load. The output drive means is engaged to the input drive and responds to the force of the input drive to pull and release the load.

A braking means is normally associated with the input means so that the output means can be rotated only when the input means is turned. The braking means can be disengaged from the input drive allowing the input and output drives to rotate freely. When the brake is disengaged the hoist operates in the free chaining mode. The braking means is responsive to the speed of the chain passing through the output means. When the speed has increased to a first predetermined value, the braking means engages and brakes the drive means.

If the acceleration of the chain exceeds a second predetermined value the braking means will engage the output means and stop the load's motion even at low speeds.

Thus, the load is prevented from a catastrophic fall. The use of a locking means which reacts to velocity insures that a gentle acceleration will not produce an injury. This is particularly a problem with respect to light loads. Light loads do not provide a high acceleration when they fall due to the friction and inertia of the hoist mechanism. The acceleration sensitive feature stops a rapidly accelerating load quickly before its velocity builds to an appreciable level. Rapid acceleration is a characteristic of heavy loads which should be stopped before appreciable momentum has been built up. If too much momentum is achieved by the load, the brake may be unable to stop the load's fall.

As a further feature of this invention, the input drive means includes an annular member slideably mounted on a drive shaft. One face of the member is a cam follower with the opposite face being a braking surface. A plate is rigidly mounted on the drive shaft and is prevented from rotation about the drive shaft. The annular member is biased towards the plate by an annular cam so the drive shaft will not turn absent a rotational force applied to the drive shaft. The locking means acts on the annular cam to keep the cam from engaging the annular member. In the disengaged mode the drive means can rotate freely as long as the lock is engaged. When the lock releases the cam it will force the annular member against the plate stopping the drive means.

As yet a further feature the locking means of this invention includes a detent mounted on the spiral cam. A reciprocally mounted pawl is located within the hoist's housing and radially outward with respect to the detent. The spiral cam can be rotated against the biasing force so that it does not engage the annular member. The pawl will then engage the detent holding the spiral cam in a disengaged position. When the spiral cam is disengaged from the annular member, the output drive will rotate freely allowing free chaining of the hoist. If the output drive is rapidly accelerated the angular acceleration vector will tend to move the pawl radially away from the detent. If the angular acceleration is sufficiently high the acceleration will completely disengage the pawl from the detent allowing the biasing means to force the spiral cam against the annular member braking the output drive.

Also there is a centrifugal force acting to disengage the pawl and detent. When the velocity of the pawl being rotated by the output drive reaches a second predetermined level the pawl and detent will disengage braking the load's movement. In most situations the disengagement of the pawl and detent will be a result of both effects, although either effect could predominate.

The engaging faces of the pawl and detent can be formed at a slight angle to the radius of the cam. In this configuration the detent and pawl can be manually disengaged by applying a rotational force to the annular member.

BRIEF DESCRIPTION OF THE DRAWINGS

In the accompanying drawing:

FIG. 1 is a side view of a lever driven chain hoist;

FIG. 2 is a partial front view in section of the driving mechanism;

FIG. 3 is a sectional view taken along the line 3—3 of FIG. 2 and;

DETAILED DESCRIPTION OF THE PREFERRED EMBODIMENTS

Figure 4:
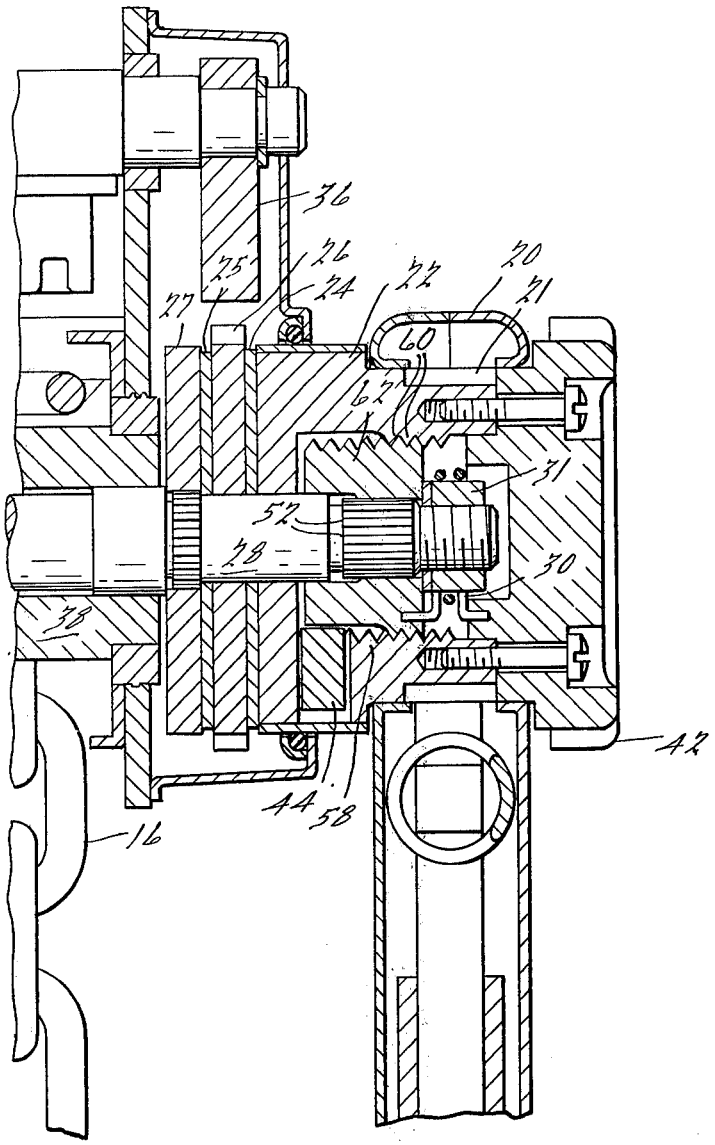
FIG. 4 is a partial front view in section of an alternate drive means.

The invention is described with reference to a common chain hoist of the type often used for lifting loads in shops.

In general, the hoist 10 comprises a housing 12 having an upstanding hook 14 for mounting the hoist, such as to an overhead support. A chain 16 passes through the hoist 10 and extends away from the hoist. At one end of the chain 16 is a hook 18 which can be attached to a load to be lifted or moved. An input force for operating the hoist 10 is applied by means of a lever 20.

One driving mechanism suitable for use with the hoist 10 is shown in greater detail in FIG. 2. As the lever 20 is rotated a detent (not shown) in the handle engages teeth 21 on an annular member 22. The rotational force generated drives the hoist through a cam type Weston brake. A helical torsion spring 30 surrounds a nut 31 which retains cam 32 on shaft 28. The spring is anchored in the knob 42 and spiral cam 32. The spring will rotate the spiral cam 32 to a position where the cam surface engages a spiral cam follower 34 formed on one face of the annular member 22. As a result frictional material 24, 25 located on the face of annular member 22 opposite the spiral cam follower 34 grips the ratchet wheel 26 and disc 27 locking the assembly into a unit which rotates a shaft 28 in response to movement of the lever 20. A ratchet pawl 36 allows movement of the ratchet wheel 26 in only one direction. The chain may be pulled in the lift direction at any time.

As the lever is turned power is transmitted through the locked brake to disc 27 and the drive shaft 28. The power applied to drive shaft 28 is transmitted to a gear box (not shown) such drive mechanisms being well known in the chain hoist art. The gear box drives an annular chain sprocket 38 which moves the chain 16 through the hoist 10. The pawl 36 controls the direction the ratchet wheel and disc are turned, regulating the direction the chain can be moved with the handle 20.

To operate the hoist in a free chain mode the knob 42 is turned against the torsional force of the spring 30. This moves the annular member 22 and spiral cam 32 out of engagement with the ratchet wheel 26 and disc 27. A pawl 44 (shown in FIG. 3) reciprocally mounted on a pin 45 drops into engagement with a detent 46 formed on the spiral cam 32. The pawl 44 holds the spiral cam 32 in the disengaged position and is urged into engagement with the detent by a spring 48 and pin 49. As the chain 16 is moved through the hoist 10, the chain sprocket 38 will turn the drive shaft 28. Because the spiral cam 32 is rotationally affixed to the driveshaft 28 by splines 52 the spiral cam will rotate with the shaft. The shaft's rotation creates a centrifugal force on the pawl 44 tending to move the pawl 44 out of engagement with the detent 46. When the pawl 44 disengages from detent 46, the spiral cam will be biased into engagement with the annular member 22, ratchet wheel 26, and the disc 27 braking the drive shaft 28 and stopping the load's movement.

The angular acceleration or velocity needed to disengage the pawl depends primarily on the pawl's weight, distance from the pin 45 to the center line of the spiral cam, location of the pawl's center of mass and the bias force of the spring. Changes in these variables will vary the acceleration and speed at which the pawl disengages. Thus one skilled in the art can construct a brake with the desired characteristics by means of simple calculations and minimal experimentation.

FIG. 4 shows a second braking means employing a screw type Weston brake. In this embodiment an annular member 58 having internal threads 60 is slideably mounted on the drive shaft 28. An externally threaded member 62 is splined to the drive shaft 28. The threads on the annular member 58 and threaded member 62 cooperate to force the friction surface 24 into engagement with the ratchet wheel 26. In this position the lever can be used to drive the shaft and the chain as described hereinbefore. To place the hoist in a free chaining mode the knob 42 is rotated to back the threaded member 62 away from the annular member 58. The pawl 44 can then engage the detent 46 on the annular member holding the parts in the disengaged position. The chain can then be pulled freely through the hoist. The pawl operates as described before to insure that the velocity and acceleration remain at safe low levels.

As a further refinement (shown in FIG. 3) the pawl face can be shaped or sloped at an angle to the radii of the drive shaft and annular member so that the force of the detent against the pawl's face will counteract the effects of friction. In this configuration the force of the cam's detent against the pawl will balance the force of friction acting to prevent the pawl from disengaging. This allows the pawl to operate in a manner which more closely reflects the theoretical ideal. Greater detent face angles will allow the detent to be manually overridden returning the brake to normal operation.

What is claimed is:

1. A hoist for lifting loads having an input drive and an output drive, the output drive being adapted to engage a chain attached to the load, the hoist having means to transmit force from the input drive to the output drive, the transmitting means comprising:

- a splined shaft rotatably mounted within a housing and attached to the output drive;
- a plate, having friction material on one face thereof, rigidly mounted on the splined shaft;
- an annular member mounted on the splined shaft, having a gripping surface on the surface facing the plate and a spiral cam follower surface on the opposite face, the member being adapted for rotational and axial movement along the splined shaft;
- a ratchet wheel having a plurality of teeth rotatably mounted on the shaft between the plate and a spiral cam member so that the gripping surface can engage the sides of the ratchet wheel, the ratchet wheel being adapted to transmit force from the input drive;
- a pawl which allows rotation of the ratchet wheel in only one direction;
- the spiral cam member mounted on the splined shaft is prevented from either angular or axial movement relative to the shaft and has associated therewith biasing means for biasing the spiral cam member into engagement with the spiral cam follower so that the sides of the ratchet wheel are firmly gripped by the friction material;
- means for rotationally moving the spiral cam member relative to the cam follower to a disengaged position whereby the ratchet wheel is not contacted by the frictional material; and
- a locking means suitable for holding the spiral cam member in a disengaged position to allow free chaining of the hoist, the locking means being sensitive to an acceleration of a first magnitude produced by a force acting at an angle to a surface of the locking means which will cause the locking means to disengage and the locking means being sensitive to an angular velocity of a second magnitude produced by a centrifugal force acting through the center of mass of the locking means which will cause the locking means to disengage; the disengagement of the locking means releases the biasing means which moves the spiral cam member into engagement with the annular member thereby applying a braking force to the output drive and stopping the free movement of the chain.

2. The hoist of claim 1 where the locking means comprises:

a detent mounted on or formed in the cam or threaded member; and a pawl reciprocally mounted on the annular member, the pawl being urged into engagement with the detent to hold the annular member in an unengaged position during free chaining, the detent and the pawl having falls which are disposed at an angle to the radius of the drive shaft.

3. A hoist mechanism including:

A. a driving means;

B. an input means engaging the driving means and being driven thereby, the input means comprising:

1. an annular member axially moveable along a shaft, one face of the annular member being a cam follower and the opposite face of the annular member being a braking surface, said annular member engaging said driving means,
2. a plate locked to the shaft, so that when the braking face of the annular member engages the plate the output shaft is prevented from rotating absent an activating force,
3. a spiral cam attached to the shaft and normally biased into engagement with the annular member, and
4. means for retaining the spiral cam in a disengaged position so that the output shaft can rotate freely allowing the chain to move freely, the retaining means being sensitive to acceleration of a first magnitude produced by a force acting at an angle to the surface of the retaining means which will cause the retaining means to disengage, and the retaining means being sensitive to an angular velocity of a second magnitude produced by a centrifugal force acting through the center of mass of the retaining means which will cause the retaining means to disengage;

C. output means driven by the output shaft and adapted to engage holding means suitable for holding and moving a load, the motion of said output means being transmitted to said retaining means;

whereby when said retaining means is disengaged the annular member contacts the plate braking and thereby stopping movement of the output member.

4. The hoisting mechanism of claim 3 wherein, the retaining means comprises:

a detent having a sloped surface mounted on the spiral cam; and a reciprocally mounted pawl, having a sloped mating surface adapted to engage the detent, which can be rotated into engagement with the detent to retain the locking means in an open configuration, the pawl being biased into engagement with the detent so that a predetermined angular velocity or acceleration will move the pawl out of engagement with the detent allowing the brake to be activated.

5. A lever hoist suitable for drawing and releasing loads including:

A. an input drive means responsive to a corresponding input force from the lever, the input drive means comprising:

1. an annular member axially moveable along a shaft, one face of the annular member being a cam follower and the opposite face a braking surface,
2. a plate which is locked from free rotation about the shaft so that when the braking face of the annular member engages the plate, the shaft is prevented from rotating absent an activating force,
3. a spiral cam attached to the shaft and normally biased into engagement with the cam follower face of the annular member, and
4. means for retaining the spiral cam in a disengaged position so said shaft can rotate freely, the retaining means being sensitive to an acceleration of a first magnitude produced by a force acting at an angle to a surface of the retaining means which will cause the retaining means to disengage and the retaining means being sensitive to an angular velocity of a second magnitude produced by a centrifugal force acting through the center of mass of the retaining means which will cause the retaining means to disengage; and B. an output drive means which engages a chain attached to the load, the output drive means being connected to and driven by the shaft of the input drive means;

whereby when the retaining means holds the spiral cam in a disengaged position, the shaft and output means can rotate freely and when the spiral cam is in the engaged position the load will be prevented from moving absent a force applied to the lever.

6. The hoist of claim 5 where the retaining means comprises:

a detent having a sloped surface mounted on the spiral cam and a reciprocally mounted pawl having a mating sloped surface which can be rotated into engagement with the detent to retain the locking means in an open configuration, the pawl being biased into engagement with the detent so that a predetermined angular velocity or acceleration will move the pawl out of engagement with the detent allowing the brake to be activated.

7. A hoist mechanism including:

A. a driving means;

B. an input means engaging the drive means and being driven thereby, the input means comprising:

1. an annular member axially moveable along a shaft, one face of the annular member being a braking surface, and having a threaded portion;
2. a plate which is locked to the shaft so that when a braking force is applied to the plate by the annular member, the shaft is prevented from rotating absent an activating force,
3. a mating threaded member for engaging said threaded portion and being splined to the shaft and engaging the output drive and normally biasing the annular member against the plate,
4. means for retaining the threaded member in a disengaged position allowing the shaft to rotate freely, the retaining means being sensitive to an acceleration of a first magnitude produced by a force acting at an angle to a surface of the retaining means which will cause the retaining means to disengage and the retaining means being sensitive to an angular velocity of a second magnitude produced by a centrifugal force acting through center of mass of the retaining means which will cause the retaining means to disengage; and C. an output means driven by the shaft and adapted to engage holding means suitable for holding a load, the output means being moveable without an activating force when the threaded member is in the disengaged position and being prevented from motion, absent an activating force when the threaded member is engaged.

* * * * *